United States Patent [19]

McFarland et al.

[11] 4,418,861

[45] Dec. 6, 1983

[54] HEXAGONAL CONTAINER

[75] Inventors: William W. McFarland, Georgetown; Baxter Beavers, Pawley's Island, both of S.C.

[73] Assignee: International Paper Company, New York, N.Y.

[21] Appl. No.: 351,395

[22] Filed: Feb. 23, 1982

[51] Int. Cl.[3] ..... B65D 13/00; B65D 5/32

[52] U.S. Cl. ..... 229/23 A; 229/41 C

[58] Field of Search ..... 229/41 C, 23 R, 23 A, 229/23 BT

[56] References Cited

U.S. PATENT DOCUMENTS

| | | | |
|---|---|---|---|
| 1,555,054 | 9/1925 | Berkowitz . | |
| 2,019,787 | 11/1935 | Leopold | 229/41 C |
| 2,021,234 | 11/1935 | Gomes | 229/45 |
| 2,123,147 | 7/1938 | Snyder | 229/41 C |
| 2,565,188 | 8/1951 | Welshenbach | 229/16 |
| 2,674,400 | 4/1954 | Ron | 229/41 C |
| 2,741,416 | 4/1956 | Hileman | 229/41 |
| 2,922,562 | 1/1960 | Pellaton | 229/41 |
| 3,014,637 | 12/1961 | Wilson | 229/23 R |
| 3,101,167 | 8/1963 | Styler | 229/41 |
| 3,115,292 | 12/1963 | Repking | 229/23 BT |
| 3,700,161 | 10/1972 | Bundy | 229/41 C |
| 4,065,047 | 12/1977 | Swan | 229/41 |
| 4,166,567 | 9/1979 | Beach, Jr. et al. | 229/23 |

FOREIGN PATENT DOCUMENTS

| | | | |
|---|---|---|---|
| 2276230 | 1/1976 | France | 229/41 C |

*Primary Examiner*—Herbert F. Ross

*Attorney, Agent, or Firm*—Jay S. Cinamon

[57] ABSTRACT

A hexagonal paperboard container, which comprises:

(a) a one-piece, upstanding, generally tubular, reinforcing member consisting of six, foldably connected, substantially rectangular, upstanding, reinforcing panels;

(b) a one-piece body member having two sets of three, substantially rectangular, foldably connected, upstanding side wall panels and a bottom wall foldably connected along its opposite sides to the central side wall panel of each set of side wall panels;

(c) the sets of side wall panels being located on opposite sides of the tubular reinforcing member and the side wall panels being bonded to the reinforcing panels;

(d) two of said reinforcing panels which are bonded to the central side wall panels having abutting major flaps foldably connected thereto at the bottom edges thereof;

(e) the four remaining reinforcing panels having minor flaps foldably connected thereto at the bottom edges thereof;

(f) said major and minor flaps extending substantially horizontally and fitting together to form a bottom wall for the reinforcing member which lies above the bottom wall of the body member whereby a double-thickness container bottom wall is formed.

6 Claims, 10 Drawing Figures

FIG. 3
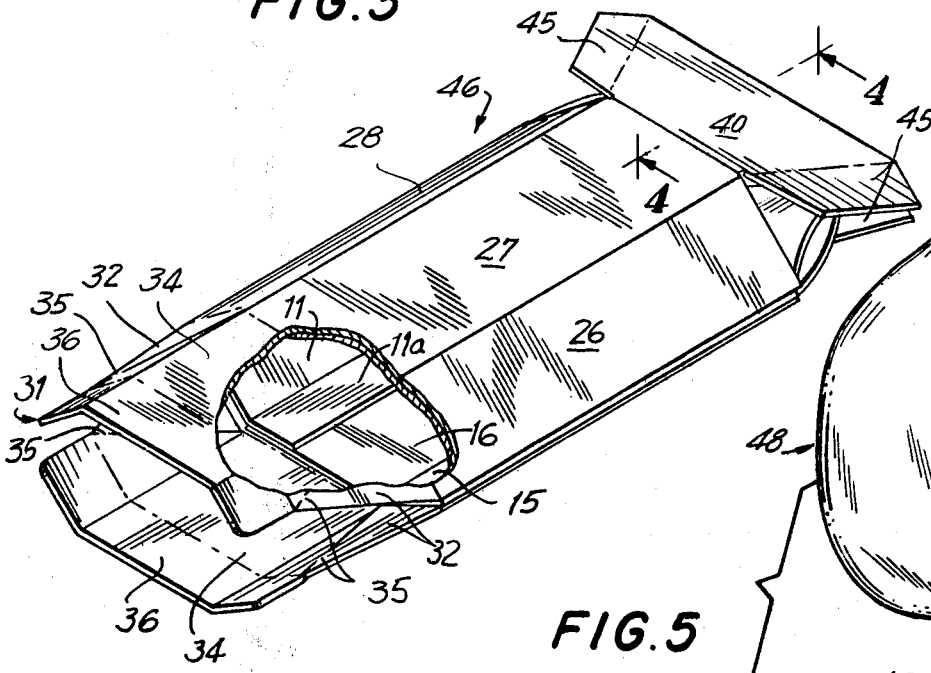
FIG. 5
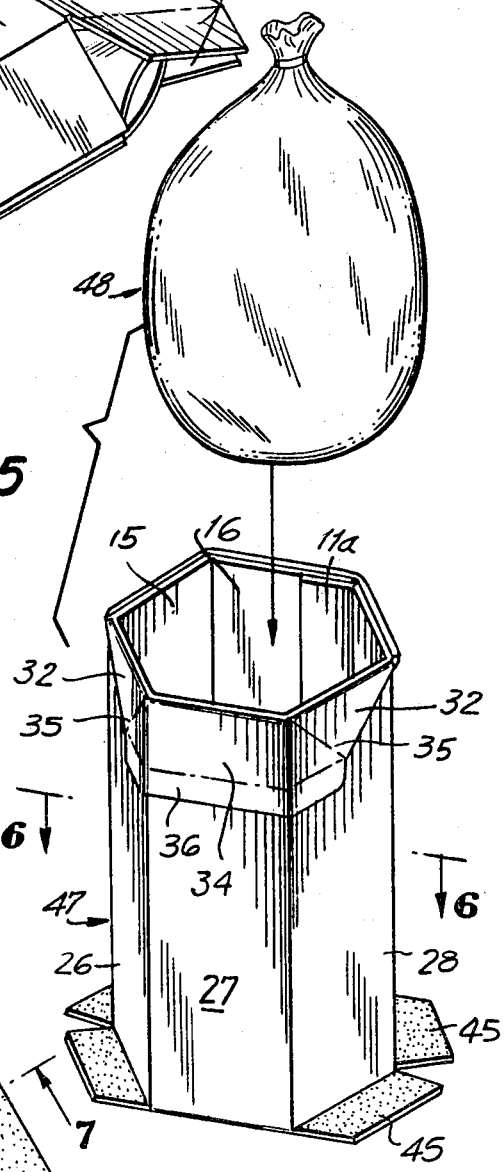
FIG. 4
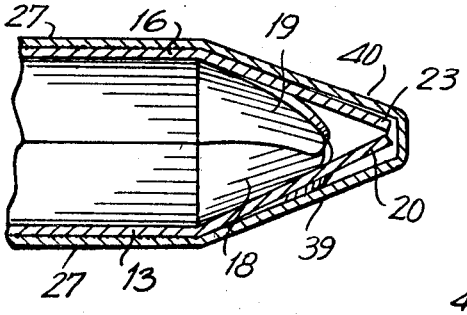
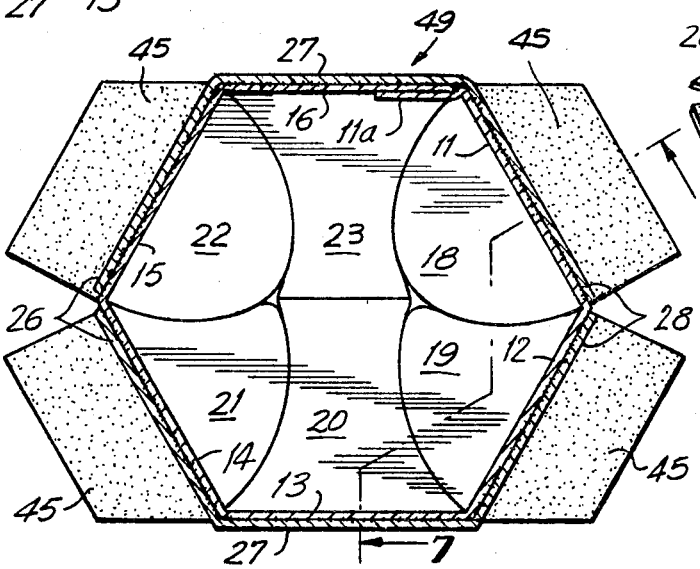
FIG. 6

HEXAGONAL CONTAINER

BACKGROUND OF THE INVENTION

1. Field of the Invention

This invention relates to a multisided corrugated paperboard container comprising a one-piece body member and a one-piece reinforcing member. More particularly, this invention relates to a hexagonal container formed from a one-piece body member and a one-piece reinforcing member having a double thickness bottom structure which can be readily and quickly erected while avoiding tearing of the container at its corners.

2. Description of the State of the Art

It is known in the art to provide hexagonal corrugated containers with side-wall reinforcement in the form of inner reinforcing members in order to strengthen the containers and thus facilitate the transportation and storage of materials, such as chemicals and food products, in a safe, efficient, and reliable manner. Increasingly, hexagonal containers are being used for the disposal of waste chemicals, since they are cheaper than the steel drums which are customarily used and, additionally, they can be incinerated. In all of these applications, however, not only must the container side walls be strengthened and reinforced to protect against the heavy-duty loads container therein, but the bottom wall of the container must also be strengthened since it bears the entire weight of the load.

Leopold, U.S. Pat. No. 2,019,787, for example, discloses an inner reinforcing member having wall sections with flaps at the ends thereof. However, these flaps only form a partial, incomplete inner bottom wall which still requires the insertion of a separate element, namely, a hexagonal paperboard disk, to complete the formation of a bottom structure for the reinforcing member. Thus, the art teaches that only by utilization of such an added element can a double thickness bottom wall be created.

SUMMARY OF THE INVENTION

It is, accordingly, an object of the present invention to provide a reinforced hexagonal container formed from a one-piece body member and a one-piece reinforcing member which has an improved bottom structure.

It is another object of the present invention to provide a reinforced hexagonal container formed from a one-piece body member and a one-piece reinforcing member, each of which has an integral bottom wall, which results in a double thickness bottom wall without requiring the insertion of a separate bottom wall means.

In accordance with the foregoing objects, and other objects which will become apparent hereinafter, a novel hexagonal paperboard container is provided, in accordance with the present invention, which comprises:

(a) a one-piece, upstanding, generally tubular, reinforcing member consisting of six, foldably connected, substantially rectangular, upstanding, reinforcing panels;

(b) a one-piece body member having two sets of three, substantially rectangular, foldably connected, upstanding side wall panels and a bottom wall foldably connected along its opposite sides to the central one of said side wall panels of each set of side walls;

(c) the sets of side walls being located on opposite sides of the tubular reinforcing member and the side wall panels being bonded to the reinforcing panels;

(d) two of said reinforcing panels which are bonded to the central side wall panels having abutting major flaps foldably connected thereto at the bottom edges thereof;

(e) the four remaining reinforcing panels having minor flaps foldably connected thereto at the bottom edges thereof;

(f) said major and minor flaps extending substantially horizontally and fitting together to form a bottom wall for the reinforcing member which lies above the bottom wall of the body member whereby a double-thickness container bottom wall is formed.

BRIEF DESCRIPTION OF THE DRAWINGS

FIG. 3 is a perspective view of a collapsed envelope of this invention, formed from the blank for a reinforcing member of FIG. 1 and the blank for a body member of FIG. 2.

FIG. 4 is a sectional view, taken along the line 4—4 of FIG. 3.

FIG. 5 is a perspective view of the partially assembled hexagonal container of this invention, depicting a laden plastic bag ready for placement in the container.

FIG. 6 is a sectional view taken along the line 6—6 of FIG. 5.

DETAILED DESCRIPTION OF THE INVENTION

Figure 1:
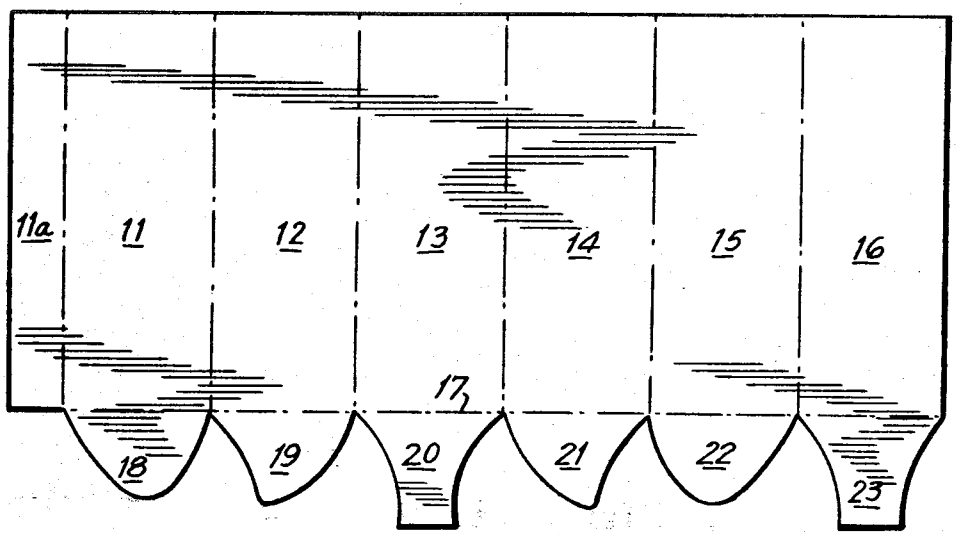
FIG. 1 is a plan view of a paperboard blank for a reinforcing member of this invention.

Referring to FIG. 1 there is shown a substantially rectangular one-piece, corrugated paperboard blank reinforcing member 10 for the hexagonal container of the present invention. The reinforcing member 10 includes six foldably connected, substantially rectangular reinforcing panels 11, 12, 13, 14, 15 and 16 which are arranged in a row. Among the six reinforcing panels, panels 13 and 16 are the central reinforcing panels. Manufacturers flap **11*a* is foldably connected to panel 11. Panels 11–16, inclusive, have foldably connected thereto at an end thereof, which end will upon assembly of the body member become its bottom edge, along a fold line 17, bottom wall forming flaps 18, 19, 20, 21, 22 and 23**, respectively.

Bottom-forming flaps 18, 19, 21 and 22, which are foldably connected to panels 11, 12, 14 and 15, respectively, are all minor flaps that have been cut along French curve radiuses. Minor flaps 18 and 22 are substantially parabolic in configuration, having two convex surfaces, and will be referred to as such herein and in the appended claims, while minor flaps 19 and 21 are generally crescent shaped in configuration, having one concave and one convex surface, and will be referred to as such herein and in the appended claims. The major bottom wall forming flaps 20 and 23, which are foldably connected to panels 13 and 16, respectively, are concave trapezoids. The term concave trapezoid is intended to mean and refer herein and in the appended claims to a flap having a longer base along the end which is foldably connected along fold line 17 to rectangular panels 13 and 16 then at its free end, and where the flap is concave along both of its side edges. The orientation of the various minor and major flaps with respect to one another in the formation of the interior bottom wall will be discussed hereafter.

Figure 2:
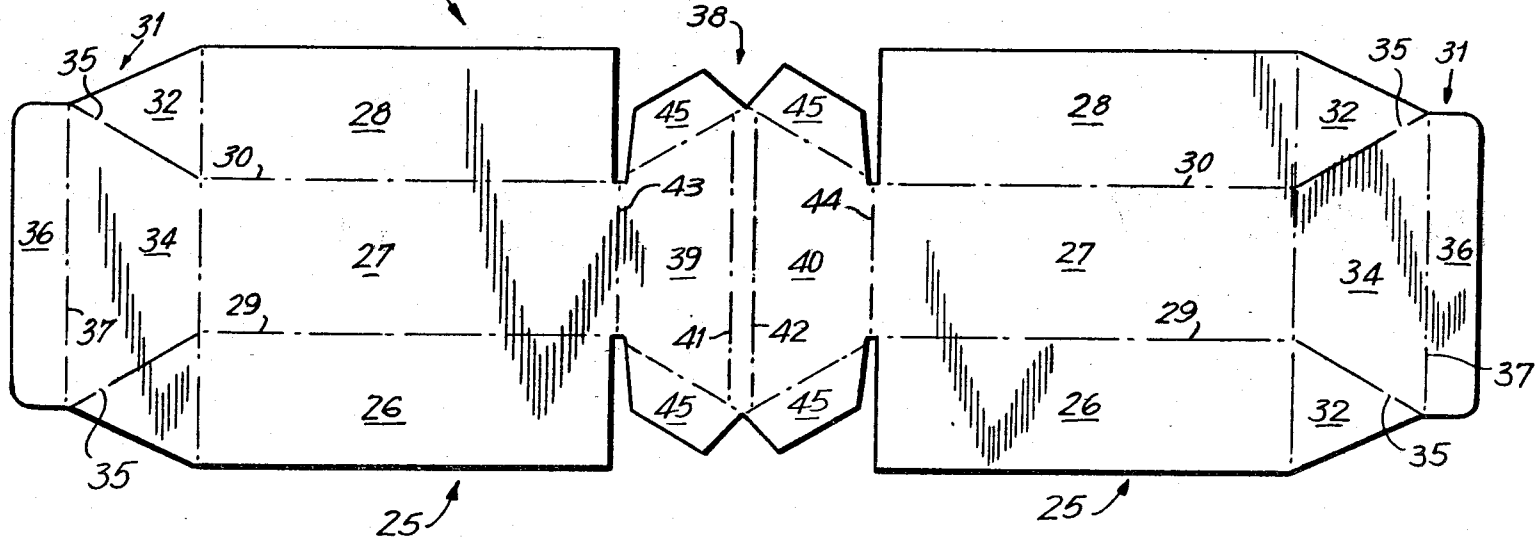
FIG. 2 is a plan view of a paperboard blank for a body member of this invention.

There is shown in FIG. 2 a one-piece, corrugated paperboard blank for a body member 24 of the hexagonal container of the present invention. The body member blank 24 is provided with two sets, generally 25, of three substantially rectangular, foldably connected side wall panels, 26, 27 and 28, arranged in a row. Among the side wall panels, panels 27 are the central side wall panels. The particular dimensions of the side wall panels are not critical provided the widths of the side walls as measured transversely of fold lines 29 and 30 between them are substantially the same as the widths of the reinforcing panels as measured transversely of the fold lines between them. Preferably, the length and width of each side wall panel is substantially the same. It is also preferred that the dimensions of the side wall panels be substantially the same as those of the reinforcing panels.

Foldably connected to each set of side walls 25, are top closure forming sections 31. Top closure sections 31 consist of triangular panels 32 which are foldably connected to end side wall panels 26 and 28, respectively, and a trapezoidal panel 34 which is disposed between triangular panels 32 and which is foldably connected to central side wall panel 27. The knife cut separating triangular panels 32 from trapezoidal panel 34, in each top closure section 31, is interrupted thus resulting in skip cuts or nicks 35 which serve to maintain each top closure section intact until the container is filled. A closure flap 36 is foldably connected to trapezoidal panel 34 along fold line 37.

Intermediate each of the central side wall panels 27 and foldably connected thereto is a bottom wall 38. The bottom wall 38 comprises bottom panels 39 and 40 which are foldably connected by score lines 41 and 42. Bottom panels 39 and 40 are, at their bases, foldably connected to the central panels 27 along score lines 43 and 44, which are substantially parallel to each other and to score lines 41 and 42. Foldably connected to each of the bottom panels 39 and 40 are a pair of bottom flanges 45.

FIG. 3 illustrates a generally flat or collapsed container envelope of the present invention, generally designated as 46, which is formed from the reinforcing member blank 10, illustrated in FIG. 1, and the body member blank 24, illustrated in FIG. 2.

In forming the collapsed envelope 46, the reinforcing member blank 10 of FIG. 1 is initially folded about two of the fold lines between its foldably connected reinforcing panels, so that the free lateral edge of panel 16 is secured, for example, by glue, in overlapping relationship to manufacturer's flap 11*a* along substantially its entire length. After completion of the gluing, the reinforcing member is generally tubular in configuration, as may be observed by reference to FIGS. 3 and 5.

The body member blank 24 is then folded in half about fold lines 41 and 42 to form the folded body member 24 shown in FIG. 3. The two sets of side wall panels 26, 27 and 28 are then provided on opposite sides of the folded reinforcing member 10. One set, 25, of side wall panels 26, 27 and 28 is provided beneath and adjacent to reinforcing panels 11, 16 and 15 and the other set 25 of side wall panels 26, 27 and 28 is provided above and adjacent to the three other reinforcing panels.

Thereafter, the sets of side wall panels are bonded preferably adhesively bonded, to their associated reinforcing panel to form the collapsed envelope 46 of this invention, as shown in FIG. 3. It is preferred in forming the envelope 46 that each side wall panel be bonded to a reinforcing panel over substantially the entire area of the reinforcing panel.

In the collapsed envelope 46, the bottom wall panel 40 connected to one set, 25, of side wall panels, lies directly above the bottom panel 39 connected to the other set, 25, of side wal panels. The top closure sections 31 are depicted as being intact and in the open position, in the envelope of FIG. 3.

FIG. 4 illustrates the orientation of certain of the major and minor flaps of the reinforcing member with respect to the bottom panels of the body member, while the container is still in the condition of a collapsed envelope. Major flaps 20 and 23 lie beneath and substantially parallel to bottom panels 39 and 40, with the free edges of flaps 20 and 23 in contact with each other. It can also be seen that crescent shaped minor flap 19 is in overlying partial contact with respect to parabolic minor flap 18.

FIG. 5 illustrates the hexagonal container 47 of the present invention in the erect condition with the top closure sections 31 folded downwardly substantially 180° until each top closure section contacts the surface of the side wall panels. The skip-cuts 35 serve to maintain the top closure sections 31 in their downward attitude while the container 47 is being filled. This top closure hold-down feature greatly facilitates the filling of the container 47 with the waste chemicals, for example, contained in plastic bag 48. After the container 47 is filled, the skip cuts are then broken freeing the now separated triangular and trapezoidal panels and allowing them to move upwardly. The completion of the top closures is described hereafter with reference to FIGS. 8, 9 and 10. The flanges 45, at the bottom of the container, are disposed substantially at right angles to the side wall panels of the erect container and a bonding material, such as adhesive, has been placed on their surfaces.

The container of FIG. 5 is set-up from the collapsed envelope of FIG. 3 by exerting a downward force at the top edges of the side wall panels until their bottom edges contact bottom wall panels 39 and 40. During this set-up procedure, the bottom walls of the body member and the reinforcing member are formed, and the flanges 45 are folded upwardly and adhesively secured to the side wall panels to maintain the container in an erect attitude. The container can be set-up either manually or by automatic equipment.

The orientation and interfitting of the major and minor flaps of the reinforcing member, which are all disposed substantially horizontally, i.e., perpendicularly, with respect to its reinforcing panels, to form a complete, separate and distinct bottom wall, 49, which is not bonded to the bottom wall 38 of the body member, 24, is clearly shown in FIG. 6. Concave trapezoidal flaps 20 and 23 are in abutting contact at their free edges. The crescent shaped flaps 19 and 21 are disposed on either side of concave trapezoidal flap 20, with the convex surfaces of the flaps 19 and 21 interfitting with the concave surfaces of trapezoidal flap 20.

Similarly, the parabolic shaped shaped minor flaps 18 and 22 are disposed on either side of the other concave trapezoidal flap 23, with a convex surface of flaps 18 and 22 filling the concavity on either side of major flap 23, and the other convex surface of flaps 18 and 22 filling the concave surface of flaps 19 and 21. The interfitting or interengagement of the two major and four minor flaps to form bottom wall 49 can best be analogized to the manner in which the pieces of a jigsaw puzzle fit together resulting in an integral, coplanar, unbonded, complete bottom wall structure 49 for the reinforcing member 10.

The bottom wall 49 of the reinforcing member 10 overlies and is in contact with bottom panels 39 and 40, which form the bottom wall 38 of the body member 24 of the container. The resultant container bottom wall comprises a double thickness of corrugated paperboard which can effectively withstand heavy loads without compromising the structural integrity of the container.

Thus, in accordance with the present invention the major flaps 20 and 23 are able to fold freely and abut positively, whereby the corners between the score lines are forced to fold outwardly without causing tearing during erection. In addition, the minor flaps 18, 19, 21 and 22 are cut at such radiuses and lengths so as to permit their being lifted by the bottom panels 39 and 40 of the body member 24 and then folded without interruption to effect a smooth and uninterrupted set-up of the bottom wall 49 of reinforcing member 10.

Figure 7:
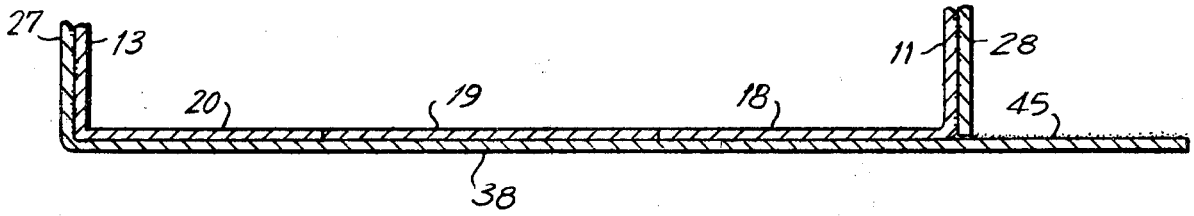
FIG. 7 is a sectional view taken along the line 7—7 of FIG. 6.

FIG. 7 shows flaps 20, 19 and 18 of the reinforcing member overlying and contacting the bottom wall 38 of the body member 24 to form the double thickness bottom wall of the hexagonal container 47 of the present invention.

Figure 8:
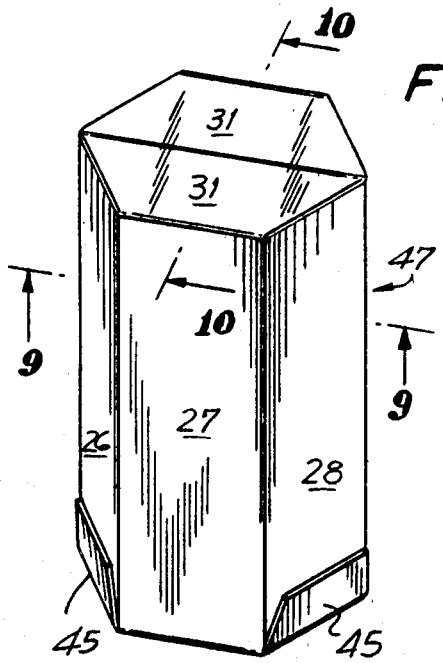
FIG. 8 is a perspective view of the assembled container of this invention.

FIG. 8 depicts the completed, erected hexagonal container 47 of the present invention with top closure sections 31 in the closed position and with flanges 45 adhesively bonded to the side wall panels.

Figure 9:
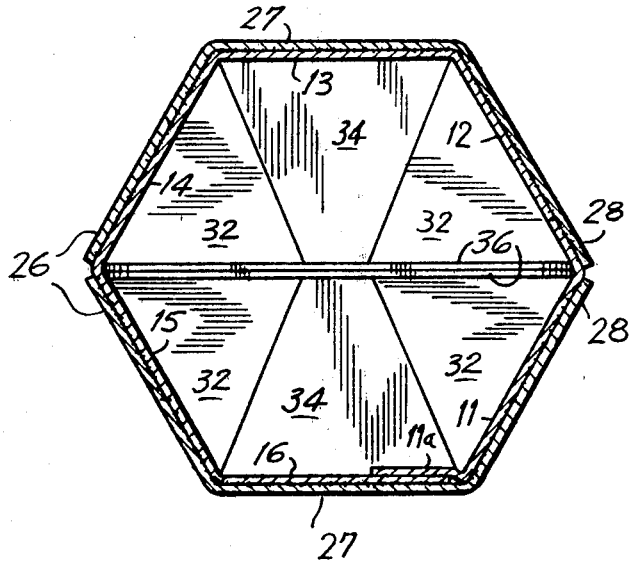
FIG. 9 is a sectional view taken along the line 9—9 of FIG. 8.

FIG. 9 is a sectional view depicting the alignment of the panels comprising the top closure sections 31. Portions of trapezoidal panels 34 are shown disposed between triangular panels 32, with closure flaps 36 serving to lock the top of the hexagonal container 47.

Figure 10:
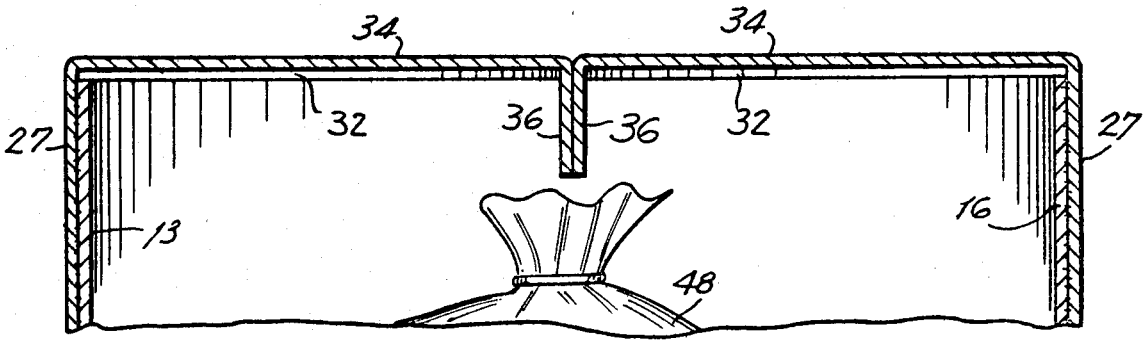
FIG. 10 is a sectional view taken along the line 10—10 of FIG. 8.

FIG. 10 illustrates the interior of the hexagonal container 47 adjacent the top closure sections 31. Trapezoidal panels 34 extend substantially horizontally with respect to the longitudinal axis of the container 47 and are in overlying contact with horizontally extending triangular panels 32. The closure flaps 36 meet in the center and extend downwardly into the container 47, substantially at right angles to the trapezoidal panels 34.

From the foregoing description it can be appreciated that the reinforced, hexagonal container of the present invention, having an integral double bottom wall structure, possesses numerous advantages over prior art containers. The bottom wall of the container has been demonstrably improved insofar as strength and durability are concerned, while increasing the speed, ease and reliability of setting-up hexagonal containers.

It is to be understood that the invention is not limited to the exact details of construction, operation, or exact materials or embodiments shown and described, as obvious modifications and equivalents will be apparent to one skilled in the art, and the invention is therefore to be limited only by the scope of the appended claims.

What is claimed is:

1. A hexagonal paperboard container, which comprises:

(a) a one-piece, upstanding, generally tubular, reinforcing member consisting of six, foldably connected, substantially rectangular, upstanding, reinforcing panels;

(b) a one-piece body member having two sets of three, substantially rectangular, foldably connected, upstanding side wall panels and a bottom wall foldably connected along its opposite sides to the central side wall panel of each set of side wall panels;

(c) the sets of side wall panels being located on opposite sides of the tubular reinforcing member and the side wall panels being bonded to the reinforcing panels;

(d) two of said reinforcing panels which are bonded to the central side wall panels having abutting major flaps foldably connected thereto at the bottom edges thereof;

(e) the four remaining reinforcing panels having minor flaps foldably connected thereto at the bottom edges thereof;

(f) said major and minor flaps extending substantially horizontally and interengaging and fitting together non-overlappingly to form an integral, coplanar, unsecured bottom wall for the reinforcing member which lies above and completely covers the bottom wall of the body member whereby a double-thickness container bottom wall is formed.

2. The container in accordance with claim 1 wherein the two major flaps are concave trapezoids in configuration.

3. The container in accordance with claim 2 wherein two of the minor flaps are parabolic in configuration and the other two minor flaps are crescents in configuration.

4. The container in accordance with claim 3 wherein the parabolic flaps are disposed on either side of one of the concave trapezoidal flaps and the crescent flaps are located on either side of the other concave trapezoidal flap.

5. The container in accordance with claim 1 and including a pair of top closure sections comprising a horizontally extending trapezoidal panel foldably connected to each of said central side wall panels, each trapezoidal panel overlying pairs of substantially horizontally extending triangular panels which are foldably connected to the end side wall panels, and a downwardly extending closure flap foldably connected to each trapezoidal panel.

6. The container in accordance with claim 1 and including pairs of bottom flanges foldably connected to the bottom wall of said body member and secured to said side wall panels.

* * * * *